United States Patent [19]

Geraets et al.

[11] Patent Number: 4,943,831

[45] Date of Patent: Jul. 24, 1990

[54] FIXING DEVICE FOR FIXING A POWDER IMAGE ON A RECEIVING SHEET

[75] Inventors: Jacques J. M. Geraets, Velden; Julius V. C. Graswinckel, Arcen; Martin L. van der Sterren, Roermond, all of Netherlands

[73] Assignee: Oce-Nederland B.V., Venlo, Netherlands

[21] Appl. No.: 427,827

[22] Filed: Oct. 26, 1989

[30] Foreign Application Priority Data

Oct. 27, 1988 [NL] Netherlands ..... 8802644

[51] Int. Cl.[5] ..... G03G 15/20

[52] U.S. Cl. ..... 355/290; 355/282; 219/216

[58] Field of Search ..... 355/282, 285, 289, 290, 355/295; 219/216, 243, 469, 470; 165/89; 100/171

[56] References Cited

U.S. PATENT DOCUMENTS 4,512,649 4/1985 Derimiggio ..... 355/285

4,802,439 2/1989 Sugimoto et al. ..... 355/295 X

FOREIGN PATENT DOCUMENTS 3108095 4/1981 Fed. Rep. of Germany .

58-62677 7/1983 Japan .

OTHER PUBLICATIONS

Hoffman et al., "Roller Engaging Device," Research Disclosure, No. 209 (Disclosure No. 20906), 9/81-pp. 336-337.

*Primary Examiner*—A. T. Grimley

*Assistant Examiner*—William J. Royer

*Attorney, Agent, or Firm*—Reed Smith Shaw & McClay

[57] ABSTRACT

A fixing device for fixing a powder image on a receiving sheet in a fixing nip formed by a fixing roller and a pressure roller which has a lower flexural stiffness than the fixing roller. These rollers are pressed against one another by a stationary cushion filled with compressed air and pressing against the pressure roller in a pressure zone situated opposite the fixing nip.

When the pressure roller and the fixing roller are driven, tangentially directed frictional forces are exerted on the pressure roller that causes the pressure roller to deflect against a curved support surface which limits the deflection. The pressure roller deflected in the operative position causes a receiving sheet fed through the fixing nip to be stretched in a direction transversely of the direction of conveyance to eliminate any bubbles or corrugations in the receiving sheet.

8 Claims, 2 Drawing Sheets

FIXING DEVICE FOR FIXING A POWDER IMAGE ON A RECEIVING SHEET

FIELD OF THE INVENTION

The invention relates to a means for fixing a powder image on a receiving sheet and, in particular, to a fixing device having a pressure roller and fixing roller in which the flexural stiffness of the fixing roller is greater than the flexural stiffness of the pressure roller.

BACKGROUND OF THE INVENTION

Fixing devices for fixing a powder image on a receiving sheet are known. Normally they include a fixing roller and a pressure roller which together form a first zone which defines a fixing nip. A biasing member presses the pressure roller against the fixing roller. See Research Disclosure No. 209 (September 1981)(Discl. No. 20906 E Hoffman, et al, p. 336–337, "Roller Engaging Device"), German Application DE No. 3108095A1 and Japanese Patent Application No. 5862677, 1983.

In U.S. Pat. No. 4,553,826, a fixing device is disclosed in which the biasing member has a cylindrically curved surface which is in contact with a large part of the circumference of the pressure roller. When a receiving sheet passing through the fixing nip has more intensive expansion locally as a result of temperature or moisture content differences in the receiving sheet, causing bubbles or creases at those places, the receiving sheet may not be completely flat when it leaves the fixing nip but may show bubbles or corrugations. Additionally, creases may form due to bubbles and/or corrugations being flattened in the fixing nip.

This type of irregularity occurs particularly in polyester foils with uneven temperature distribution and in paper sheets with uneven moisture distribution.

Accordingly, it is an object of this invention to provide a fixing device in which any bubbles and/or corrugations present in the receiving sheet can be removed during fixing.

SUMMARY OF THE INVENTION

Generally, the present invention includes a pressure roller having a flexural stiffness that is so much less than the flexural stiffness of the fixing roller so that as a tangentially directed frictional force is applied on the pressure roller on rotation of the rollers, the pressure roller deflects in the direction in which the frictional force acts. Furthermore, deflection-limiting means are provided which limit the deflection of the pressure roller in the direction of the frictional force. Preferably, the ratio of flexural stiffness of the pressure roller to that of the fixing roller is 1:20 to 1:60.

By reason of the present invention, a receiving sheet fed through the fixing nip in a direction parallel to the direction in which the frictional force acts is subjected in the fixing nip to forces which, considered in the longitudinal direction of the rollers, extend from the middle to the ends of the fixing nip. These forces stretch the receiving sheet to such an extent that any bubbles and corrugations present disappear.

This effect is particularly effective in processing receiving sheets of polyester in a fixing device. In such case a powder image transferred to the fixing roller from a photoconductive support is transferred and fixed under pressure and heat on a heated polyester sheet. With such a combined transfer and fixing device the receiving material is preheated to a temperature of about 100° C. before it reaches the fixing nip. Normally, as a result of slight temperature differences present in the polyester sheet during and after preheating, bubbles or corrugations will form at those places on the polyester sheet subjected to greater expansion at the hotter places. These bubbles or corrugations enlarge as a result of the low flexural stiffness of polyester at high temperature. Since the temperature in the fixing nip is also high, a part of the polyester sheet in the fixing nip stays hot so that the sheet can easily be stretched in the fixing nip at the places where there are no bubbles or corrugations and so that bubbles and corrugations present at other places disappear.

Preferably, the flexural stiffness of the pressure roller is so small that at the frictional force causing the deflection of the pressure roller is at a minimum 0.5 mm per meter length of the pressure roller. Consequently, shortly after entering the fixing nip a sheet is sufficiently stretched for any bubbles and corrugations to disappear.

In one embodiment of the fixing device, the deflection-limiting means comprises a leaf spring which bears against the periphery of the pressure roller by a free edge, and a fixed support having a curved support surface which contacts the leaf spring upon deflection of the pressure roller. As a result, the amount of deflection can be made independent of the flexural stiffness of the pressure roller and the frictional forces exerted on the pressure roller to provide the deflection.

Preferably, the abutment can also be used as a scraper to scrape off developing powder transferred to the pressure roller and any paper dust remaining on the pressure roller. In the activated state of the fixing device, the leaf spring operating as a scraper always remains in contact with the pressure roller over the entire length thereof irrespective of the amount of deflection thereof, so that no developing powder or paper dust can pass between the scraper and the pressure roller and thus stick on the pressure roller.

In a preferred embodiment of the fixing device the pressure roller is directly driven and the biasing means is fixed in the active state to produce the frictional force required on the pressure roller for its deflection. Consequently, the amount of deflection of the pressure roller is determined almost completely by the drive torque and the friction between the biasing member and the pressure roller and only to a slight degree by the friction in the fixing nip. If, however, the frictional force required for deflection of the pressure roller is produced solely by driving the fixing roller, and a counter-acting torque is exerted on the pressure roller in combination therewith, a relatively high frictional force occurs in the fixing nip adversely affecting the fixing of a powder image on a receiving sheet fed through the fixing nip.

Other advantages of the invention will become apparent from a perusal of the following detailed description of a presently preferred embodiment taken with reference to the accompanying drawings.

PRESENTLY PREFERRED EMBODIMENT

Figure 1:
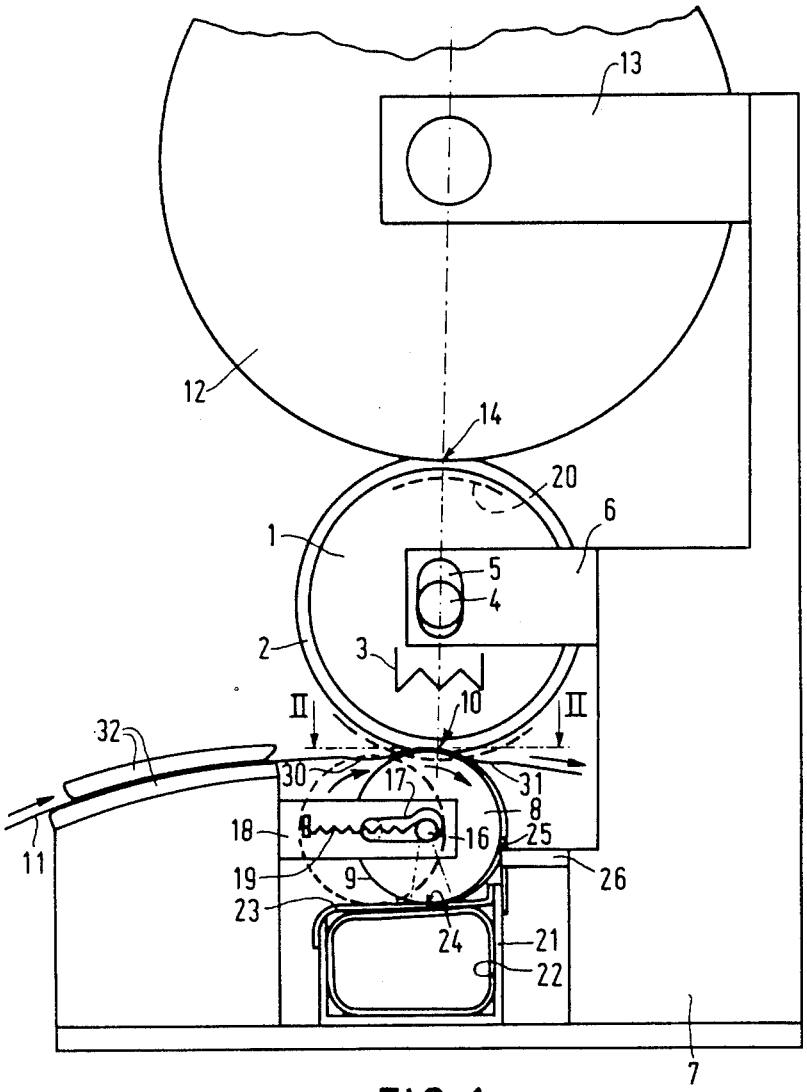
FIG. 1 is a side elevation of a fixing device according to the invention.

Referring to the Figures, the fixing device of the present invention comprises fixing roller 1 having a steel cylinder with a diameter, for example, of 100 mm and a length of 900 mm. Preferably, the cylinder is covered with silicone rubber 2 of a thickness of about 1.75 mm. Heating element 3 is provided inside the cylinder to heat the layer of silicone rubber 2 to a temperature of about 110° C. At the ends of fixing roller 1 are journals 4, each passing through an elongate hole 5. Holes 5 are formed in arms 6 mounted to frame 7.

Fixing roller 1 can be driven via a drive shaft (not shown) mounted to frame 7. Between the drive shaft and fixing roller 1 is a coupling, e.g., a Schmidt coupling, which allows fixing roller 1 to be freely movable within specific limits in the longitudinal direction of hole 5 enabling fixing roller 1 to be positioned in the direction explained hereinafter.

The fixing device also includes pressure roller 8 which has an aluminum cylinder with a diameter for example of 25 mm and a length of 900 mm. The cylinder is preferably covered with an 0.6 mm thick layer 9 of wear-resistant fluoro-ethylene propylene shrunk over the metal cylinder. However, other materials which are wear-resistant and non-adhesive to developing powder can be used. Pressure roller 8 is constructed in the form of a heat pipe to obtain a uniform temperature at the roller surface.

A photoconductive drum 12 is shown with a diameter of 200 mm rotatably mounted on a fixed location on arms 13 above fixing roller 1. Arms 13 are secured to frame 7. Photoconductive drum 12 can be brought into contact with the fixing roller 1 in zone 14 of fixing roller 1 to form a transfer nip which is substantially opposite to fixing nip 10.

In the operative position of the fixing device, photoconductive drum 12, fixing roller 1 and pressure roller 8 are pressed against one another by means described hereinafter, for the purpose, on the one hand, to form transfer nip 14 in which a powder image applied to photoconductive drum 12 is transferred to the fixing roller 1 and, on the other hand, to form fixing nip 10 through which a receiving sheet 11 can be passed for the transfer and fixing thereon of the powder image. The receiving sheet is preheated between heated plates 32. For good movement of the receiving sheet, through fixing nip 10, the diameters of pressure roller 8 and fixing roller 1 are constant within narrow limits over the entire length of the rollers.

The ends of pressure roller 8 are provided with journals 16 each passing through an elongate opening 17 formed in arms 18 secured to frame 7. The longitudinal direction of openings 17 forms an angle of about 90° with the longitudinal direction of holes 5. The opening 17 extend to the plane passing through the axes of rotation of fixing roller 1 and photoconductive drum 12, where journals 16 fit into openings 17. Openings 17 are preferably sized to provide ample clearance in the vertical direction. At the other end of the elongate openings 17, journals 16 fit into openings 17 with little vertical clearance.

In the inoperative position of the fixing device, pressure roller 8 is held by springs 19 in the position represented by the broken circular line in FIG. 1. In such position, pressure roller 8 is practically unable to move in the direction of fixing roller 1 and is free from fixing roller 1 which rests on the bottom path of elongate holes 5. This position of fixing roller 1 is represented by broken line 20 in FIG. 1.

A rectangular gutter 21 is secured to frame 7 beneath and spaced apart from fixing roller 1. Gutter 21 contains an elongate rubber cushion 22 filled with compressed air. Covering the open top of gutter 21 is strip 23 consisting of a mohair-covered fabric which lies on rubber cushion 22 without tension, but which is secured to gutter 21 on either longitudinal side.

In the inoperative position represented in broken line in FIG. 1, and in the operative position represented in solid line, and in each intermediate position, pressure roller 8 presses on the mohair surface of strip 23. In so doing, it compresses rubber cushion 22. In the operative position of the device strip 23 is in contact with a peripheral zone 24 of the pressure roller. Zone 24 defines a segment of the pressure roller which includes a segment angle of 30°. With an excess pressure of 0.8 bar in rubber cushion 22 pressure roller 8 presses against fixing roller 1 at fixing nip 10 with a force of 1,000 N per meter. Fixing roller 1 presses against photoconductive drum 12 in zone 14 with the same pressure.

Figure 2:
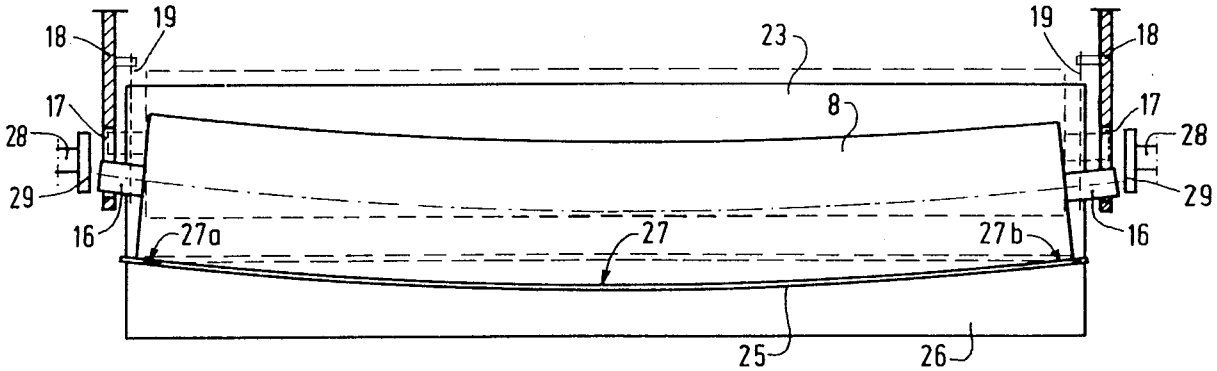
FIG. 2 is a cross-section taken along line II—II in FIG. 1.

A leaf spring 25 projecting freely upwardly is fixed to gutter 21, and preferably is a 0.6 mm thick spring steel. In the operative position of the fixing device, the free top edge of leaf spring 25 is in pressure contact with pressure roller 8 along a contact line on pressure roller 8 situated substantially in the middle between facing pressure zone 24 and fixing zone 10. The leaf spring 25 includes an angle of some tens of degrees (e.g., 5° to 15°) with the tangent to the pressure roller through the contact line. A rigid bar 26 is provided on the side of leaf spring 25 which is remote from pressure roller 8 and is immovable connected to frame 7. Bar 26 has a symmetrically curved support surface 27 on the side facing leaf spring 25 as will be seen from FIG. 2. Preferably, the radius of curvature is from about 100,000 to 200,000 mm. In the inoperative position of the fixing device in which pressure roller 8 occupies the position shown in broken line, it is free from leaf spring 25 and only ends **27*a* and 27*b* (FIG. 2) of support surface 27 being in contact with leaf spring 25**.

Pressure roller 8 is adapted to be driven via a drive shaft 28 disposed at a fixed place (see FIG. 2), through the medium of a coupling 29 which allows a variable distance between the fixed drive shaft 28 and the axis of rotation of pressure roller 8. Starting from the inoperative position of the fixing device, the drive for drive shaft 28 is switched on. Rotation of the fixing roller is in the direction indicated by an arrow in FIG. 1. Pressure roller 8 rolls over strip 23 on pressure cushion 22 providing both rotational and translational movement in the direction of leaf spring 25, thereby pressing the freely rotatable fixing roller 1 up against photoconductor drum 12. Upon coming into contact with leaf spring 25, pressure roller 8 and leaf spring 25 deflect in their respective middles. The curved shape of support surface 27 limits the deflection of leaf spring 25 and, hence, the deflection of the pressure roller 8. When the drive is switched off pressure roller 8 is again pulled back into the broken-line position by springs 19. This pull-back can also be obtained by driving pressure roller 8 in the reverse direction.

For fixing the image, the drive for fixing roller 1 is switched on and roller 1 is rotated at a speed such that its surface speed outside of transfer zone 14 and fixing zone 10 is somewhat higher (e.g., 0.5–10%) than the surface speed of the pressure roller 8 outside fixing zone 10. A frictional force is exerted in fixing nip 10 as a result of this somewhat higher speed and in combination with the frictional force exerted by strip 23 on pressure roller 8 presses it with a force of about 200 N/m against leaf spring 25 which is at its maximum deflection. This force is required to scrape clean the surface of pressure roller 8 by means of leaf spring 25.

With a preferred radius of curvature of support surface 27 between about 100,000 to 200,000 mm, pressure roller 8 can deflect from 0.5 to 1 mm at its center. The curvature of pressure roller 8 causes a speed component in the axial direction, such component extends from the center of pressure roller 8 towards the ends thereof. As a result of this axial component, a receiving sheet present between the rollers 1 and 8 is stretched axially and any bubbles and corrugations are removed. The axial speed with respect to these curvatures is about 0.3% of the transit speed. With a transit speed of 3 m/min these axial speeds are then about 0.15 mm/sec.

The stretching of receiving sheet 11 in the fixing nip 10 is apparent from the faint wrinkles 30 and 31 extending respectively just in front of and just after fixing nip 10 in a direction substantially parallel to this nip in the receiving sheet. Wrinkles 30 and 31 remain at the same place during conveyance of the receiving sheet and have no effect on the flatness thereof. Once a wrinkle has formed, it no longer changes, because there is equilibrium between the stretching force applied and the tension thus formed in the receiving sheet. If the stretching force continues, the pressure roller will slip axially over receiving sheet 11. The speed difference applied by driving fixing roller 1 and pressure roller 8 is also used to provide a relative movement between receiving sheet 11 and the powder image in fixing nip 10 to compensate for any elongation of the image which occurs in fixing nip 10 as a result of the powder image being stretched out on the pressed-in silicone rubber layer 2. The reason for this is that the friction between the covering layer 9 and receiving sheet 11 results in practically no slip at the applied nip pressure between pressure roller 8 and receiving sheet 11. Therefore slip occurs only between receiving sheet 11 and the powder image fed over the surface of fixing roller 1.

Tests have shown that the fixing device according to the invention is particularly suitable for fixing powder images on hot polyester material which, as a result of temperature differences, is fed with bubbles into the fixing nip. These bubbles are eliminated in the fixing nip.

The above-described fixing device is not dependent on a specific maximum length of the rollers for good operation. The rollers are substantially unable to deflect in a direction extending through image transfer zones 10 and 14, which would interfere with the image transfer. The fixing device is therefore extremely suitable for processing large-format receiving material. Accordingly, while a presently preferred embodiment of the invention has been shown and described in particularity, it may be otherwise embodied within the scope of the appended claims.

What is claimed is:

1. In fixing device for fixing a powder image on a receiving sheet in which a fixing roller and a pressure roller together form a first zone which defines a fixing nip, and a biasing member which presses against the pressure roller in a second zone of said pressure roller located substantially opposite to said fixing nip for tangentially directing a frictional force on said pressure roller in at least one of said zones on rotation of the rollers, the improvement in combination therewith comprising deflection-limiting means to limit deflection of said pressure roller in the direction of said frictional force and said pressure roller having a flexural stiffness much less than the flexural stiffness of said fixing roller such that at said frictional force said pressure roller deflects in the direction in which the frictional force acts.

2. A fixing device according to claim 1, wherein said flexural stiffness of said pressure roller is so small that at said frictional force the deflection of said pressure roller in its center is at a minimum 0.5 mm per meter length of the pressure roller.

3. A fixing device according to claim 1 or 2, wherein said deflection-limiting means comprise (a) a leaf spring which bears by a free edge against a periphery of the pressure roller, and (b) a fixed support having a curved support surface for supporting said leaf spring when it contacts said pressure roller on deflection.

4. A fixing device according to claim 1 or 2, wherein said pressure roller is directly drivable and said biasing member being a stationary element whereby a frictional force is generated in a zone where said biasing member contacts said pressure roller in the active state of the fixing device.

5. A fixing device according to claim 4, wherein said fixing roller is directly drivable at a circumferential speed higher than the circumferential speed of said pressure roller thereby generating a frictional force in said zone defining said fixing nip.

6. A fixing device according to claim 1 or 2, wherein said biasing member is stationary and is disposed at a fixed location, and wherein said pressure roller is rollable over said biasing member between a first position in which said pressure roller is not in contact with said fixing roller and a second position in which said pressure roller is in pressure contact with said fixing roller.

7. A fixing device according to claim 6, wherein said fixing roller is movable between a first extreme position occupied by said fixing roller in the first position of said pressure roller and a second position occupied by said fixing roller in said second position of said pressure roller.

8. A fixing device according to claim 1 or 2, wherein said biasing member comprises a cushion filled with compressed air.

* * * * *